US007234674B2

(12) United States Patent
Rippel et al.

(10) Patent No.: US 7,234,674 B2
(45) Date of Patent: Jun. 26, 2007

(54) 3-WAY ADJUSTMENT MECHANISM FOR DOWNLIGHT FIXTURE

(75) Inventors: Graham Rippel, East Walpole, MA (US); Kenneth Czech, North Dartmouth, MA (US); Gene Sartini, Fall River, MA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 45 days.

(21) Appl. No.: 11/135,562

(22) Filed: May 23, 2005

(65) Prior Publication Data

US 2006/0261235 A1 Nov. 23, 2006

(51) Int. Cl.
*B42F 13/00* (2006.01)

(52) U.S. Cl. ..... 248/343; 248/906

(58) Field of Classification Search ..... 248/343, 248/906, 314, 201, 317; 362/382, 404, 364, 362/365

See application file for complete search history.

(56) References Cited

U.S. PATENT DOCUMENTS

| | | | | |
|---|---|---|---|---|
| 2,802,933 A | | 8/1957 | Broadwin | |
| 3,313,931 A | | 4/1967 | Klugman | |
| 3,518,420 A | * | 6/1970 | Kripp | 362/257 |
| 3,609,338 A | | 9/1971 | Kripp | |
| 3,697,742 A | | 10/1972 | Bobrick | |
| 3,700,885 A | | 10/1972 | Bobrick | |
| 4,336,575 A | | 6/1982 | Gilman | |
| 4,729,080 A | | 3/1988 | Fremont et al. | |
| 5,609,414 A | | 3/1997 | Caluori | |
| 5,690,423 A | * | 11/1997 | Hentz et al. | 362/365 |
| 6,123,438 A | | 9/2000 | Hentz | |
| 6,283,430 B1 | | 9/2001 | Schubert et al. | |
| 6,336,613 B1 | * | 1/2002 | Roth | 248/27.1 |
| 6,590,155 B2 | * | 7/2003 | Vrame et al. | 174/50 |
| 2005/0067546 A1 | * | 3/2005 | Dinh | 248/343 |

* cited by examiner

*Primary Examiner*—Ramon O Ramirez
(74) *Attorney, Agent, or Firm*—James E. Cole; Middleton Reutlinger

(57) ABSTRACT

The instant invention provides an adjustable mechanism for a fixture having a fixture frame, a plurality of hanger bars, and an aperture ring. An adjustment assembly slidably connects the fixture frame, the plurality of hanger bars, and the aperture ring. The adjustment assembly allows independent vertical adjustment of hanger bars, fixture frame and aperture ring for various installation variables.

19 Claims, 9 Drawing Sheets

3-WAY ADJUSTMENT MECHANISM FOR DOWNLIGHT FIXTURE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to a downlight assembly for a recessed light in a ceiling or suspended ceiling structure. More specifically, the present invention relates to a 3-way adjustment mechanism for a downlight fixture.

2. Description of the Related Art

The term "downlight" generally refers to a type of lighting and function of a lighting fixture to provide light from a recessed volume within a ceiling of an interior space. Recessed downlights have become increasingly popular for use in both commercial and residential constructions. One reason for the increased popularity is that the recessed downlight fixtures meet a wide range of interior lighting needs and specifications while also being aesthetically pleasing. The recessed lighting fixtures come in various sizes and therefore can be used in multiple arrangements depending on room size, ceiling height and desired brightness. Further, recessed downlight fixtures may be installed in new constructions as well as retrofit in existing ceilings and therefore such fixtures appeal to installers. Typically, ceiling-mounted recessed downlight fixtures comprise a frame-in kit with a fixture frame connection means for retaining the fixture frame between structural supports within the ceiling. Such connection means are typically referred to as "hanger bars".

Downlight fixture assemblies are typically located in a ceiling with a major portion of the fixture hidden above the visible ceiling line. The fixtures are therefore unobtrusive while still providing efficient illumination within an interior space. Light is typically directed from an aperture or cavity in the ceiling wherein a lamp is disposed within the downlight fixture. Alternatively, downlight fixtures may be mounted within overhanging eves of exterior structures.

Downlight fixture assemblies are typically mounted between ceiling joists or suspended ceiling support members. In a conventional mounting of a downlight fixture, a mounting frame is provided which is secured between the joists or the suspended ceiling members also referred to as T-bars. The frame or "pan", as generally referred to by those of ordinary skill in the art, is typically formed of a heavy gauge steel having a rectangular or square shape and hanger bars extending along opposed edges of the pan to connect the pan to the joists or suspended ceiling members. A junction box is typically disposed on the mounting frame and connected to an electrical power source by way of a conduit. The frame also provides a structure for retaining a housing or "can". Within the housing or can, a reflector assembly and lamp are housed. A conduit also extends from the junction box to the can to provide power to the lamp therein.

Two installation variables have caused problems for prior art frame-in kits. First, recessed downlight fixtures may interfere with building mechanical and electrical components within the ceiling such as plumbing, rigid electrical trays and/or rigid electrical conduit, or HVAC duct. Due to these components being located within a ceiling cavity, a fixture frame may obstruct or interfere with those components when installed. The second variable encountered during installation is varying ceiling thickness. In one installation position the ceiling material may have a small thickness while in a second installation position the ceiling material may have a larger thickness. If an installer attempts to adjust for ceiling thickness he may run afoul of building mechanicals or vice-versa. Thus, vertical adjustability of the frame-in kit is problematic for prior art fixture frame-in kits.

Given the foregoing deficiencies, it will be appreciated that a recessed downlight mounting fixture frame is needed which provides multiple vertical adjustments to compensate for unknown installation variables.

SUMMARY OF THE INVENTION

With regard to the foregoing, the present invention eliminates the oversights, difficulties, and disadvantages of the prior art by providing a three-way adjustment mechanism for a recessed downlight mounting fixture frame.

According to one embodiment, an adjustable fixture frame mechanism comprises a fixture frame having a junction box connected to the fixture frame, an adjustment assembly connected to the fixture frame and slidably connecting an aperture ring to the frame. The aperture ring is slidably adjustable through a vertical plane relative to the fixture frame. The fixture frame and the aperture ring are also slidable relative to a plurality of hanger bars. The adjustment assembly comprises a frame mounting bracket, an aperture ring bracket slidably connected to the frame mounting bracket, and a hanger bar bracket. The aperture ring bracket is slidably disposed along an inner surface of the frame mounting bracket. The hanger bar bracket is slidably connected to the frame mounting bracket. A frame mounting bracket is disposed between the hanger bar bracket and the aperture ring bracket. The hanger bar bracket connects the hanger bars to the fixture frame and the aperture ring. The adjustable fixture frame mechanism further comprises a releasable fastener extending through the adjustment assembly.

According to a second embodiment, an adjustable fixture frame mechanism comprises a fixture frame, an aperture ring slidably connected to the frame by a sliding adjustment assembly, hanger bars retained by the sliding adjustment assembly and slidable relative to the fixture frame and aperture ring. The frame is vertically slidable independent of the fixture ring. The adjustable fixture assembly further comprises apertures for preselected positions of a frame and an aperture ring. The adjustment assembly comprises an aperture ring bracket, a frame mounting bracket and a sliding clamp. Each of the aperture ring bracket and the frame mounting bracket are slidable relative to the other and the sliding clamp.

According to a third embodiment, an adjustable fixture assembly, comprises a frame slide, a hanger bar slide and an aperture ring slide, the frame slide is vertically moveable relative to the hanger bar slide and the aperture ring slide. The aperture ring slide is vertically moveable relative to the hanger bar slide and the frame slide. The frame is connected to the frame slide. Multiple hanger bars are retained by the hanger bar slide. An aperture ring is connected to the aperture ring slide.

According to a fourth embodiment, an adjustable mechanism for a fixture comprises a fixture frame, a plurality of hanger bars, and an aperture ring. An adjustment assembly slidably connects the fixture frame, the plurality of hanger bars, and the aperture ring. Each of the fixture frame and the aperture ring slide relative to the other and the hanger bars.

Several benefits and advantages are derived from the broad method and/or the embodiment of the invention. The instant invention provides an adjustment assembly for use with a fixture frame, which allows independent vertical adjustment of hanger bars, fixture frame and aperture ring.

DETAILED DESCRIPTION

Figure 1:
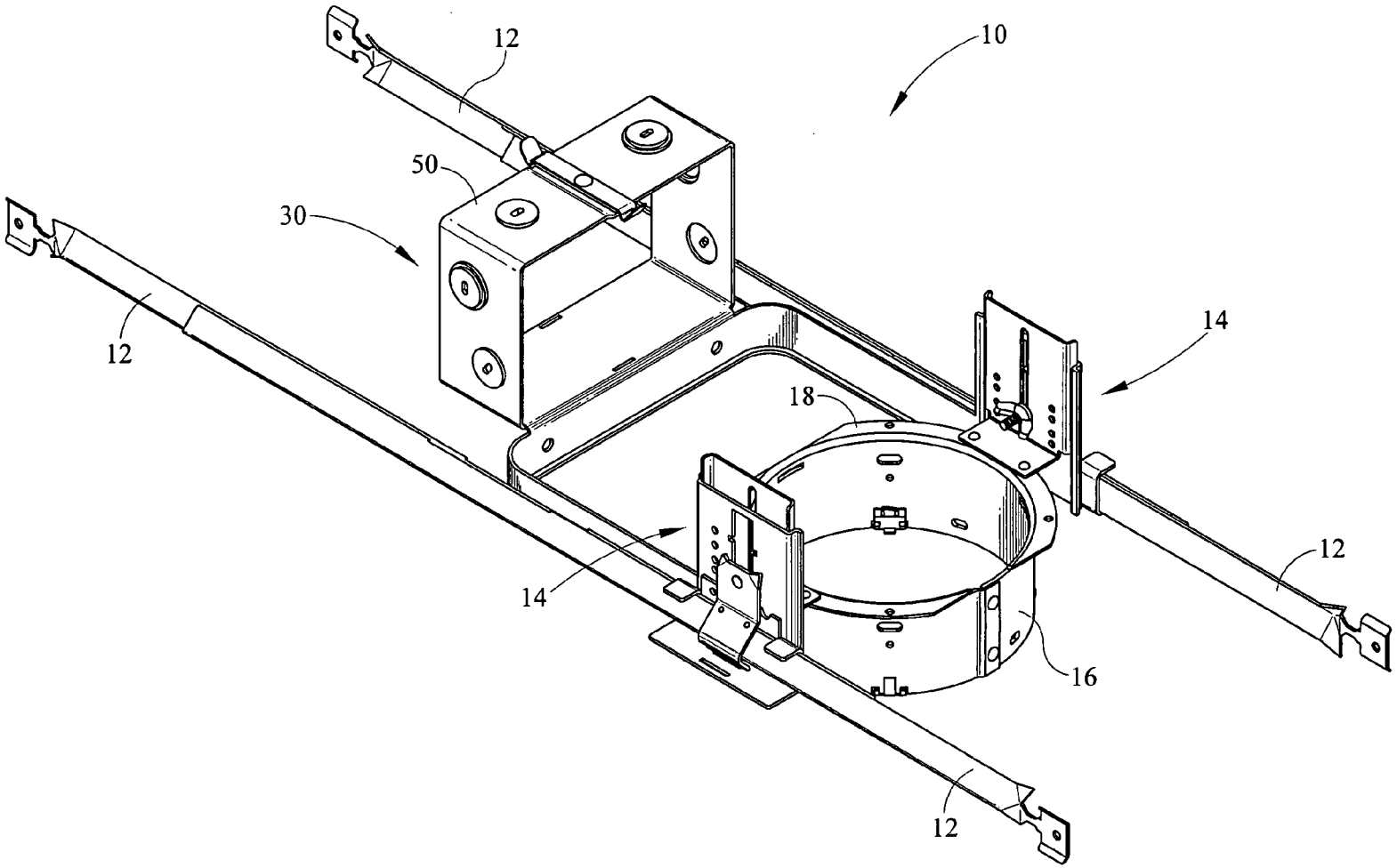
FIG. 1 is a perspective view of a fixture frame-in kit including a three-way adjustment mechanism of the present invention.

It shall be understood that the invention is not limited in its application to the details of construction and the arrangement of components set forth in the following description or illustrated in the drawings. The invention is capable of other embodiments and of being practiced or of being carried out in various ways. Also, it shall be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1 through 9 various aspects of a recessed downlight fixture frame both before and after manufacture. The fixture frame is formed from a single sheet of material or blank in order to improve manufacturing efficiency, reduce waste, and reduce cost of materials utilized in manufacturing the mounting fixture. Further, a single fixture frame blank may be utilized to form a fixture frame for use with light fixtures and reflectors of various sizes.

Referring initially to FIG. 1, a perspective view of a recessed downlight mounting or frame-in kit 10 is depicted. Generally, in use the frame-in kit 10 is positioned above an interior ceiling or in an exterior overhanging eve to provide useable downlight as well as reduce glare seen in the interior or exterior space. The frame-in kit 10 is preferably formed of a formable metallic material, such as steel, aluminum or other such lightweight metal. The frame-in kit of FIG. 1 comprises a plurality of hanger bars 12 which extend between joists or suspended ceiling members (not shown) an adjustment assembly 14, aperture ring 16 and frame 30. The hanger bars 12 are connected to the frame-in kit 10 by an adjustment assembly 14 which retains the slidable relationship between adjacent hanger bars 12 in an axial direction and also provides adjustability for various components in a vertical dimension. When the hanger bars 12 are connected to ceiling members, the frame-in kit 10 is suspended therebetween and above ceiling level.

Figure 2:
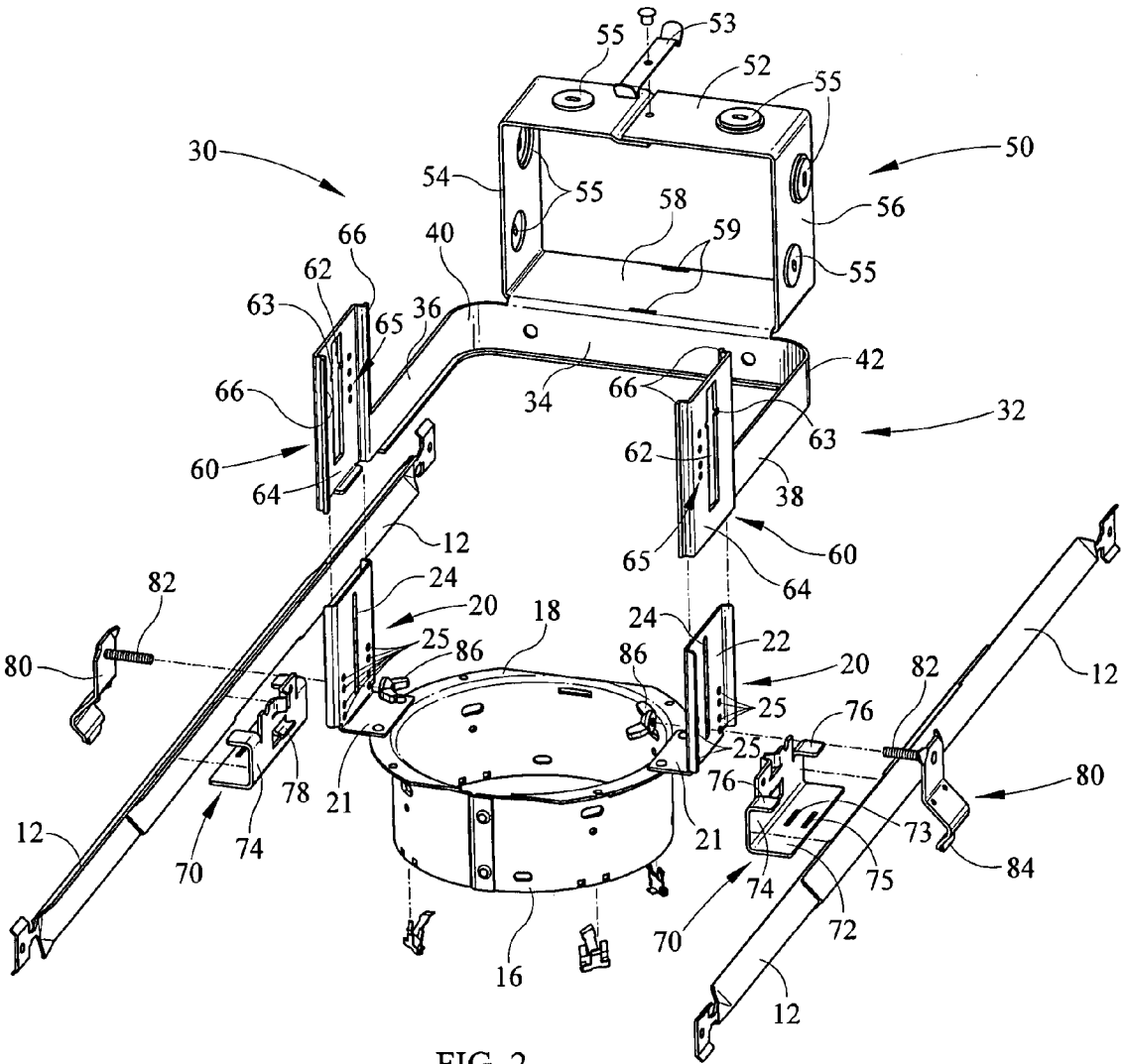
FIG. 2 is an exploded perspective view of the fixture frame-in kit and three-way adjustment mechanism of FIG. 1.

As best seen in FIGS. 1 and 2, the adjustment assembly 14 allows independent sliding motion of the frame 30, aperture ring 16, and hanger bars 12. The adjustment assembly 14 is generally comprised of a frame mounting bracket 60, an aperture ring bracket 20 and sliding clamp 70. According to the exemplary embodiment, an adjustment assembly 14 is located at diametrically opposed positions of an aperture ring 16.

The frame-in kit 10 further comprises an aperture ring 16 which is disposed along inside surfaces of the fixture frame 30. The aperture ring 16 functions to retain a housing or "can" (not shown) wherein various lighting components are located, including but not limited to, the lamp socket, the lamp, the reflector and trim (also not shown). The aperture ring 16 is substantially cylindrical in shape with a flat upper surface 18 connected to the adjustment assembly 14. As described further herein, a single fixture frame 30 can receive multiple ring sizes and therefore multiple housing or "can" sizes. The adjustment assembly 14 allows the aperture ring 16 to translate upward and downward independent of the hanger bars 12 and the frame 30 to accommodate a plurality ceiling thicknesses.

Referring now to FIG. 2, an exploded perspective view of the fixture frame-in kit 10 is depicted including the adjustment assembly 14. The fixture frame 30 comprises a frame arm 32 and an integral junction box 50. The frame 30 translates upward and downward independent to the hanger bars 12 and aperture ring 16 in order to compensate for mechanicals and electrical components in the ceiling cavity above the frame-in kit 10. The sliding motion is provided by the adjustment assembly 14. First, the junction box 50 comprises a top wall 52, a bottom wall 58 opposite the top wall 52 and opposed side walls 54, 56 extending between the top wall 52 and bottom wall 58. The junction box 50 defines an enclosure wherein input splices are located. The junction box top wall 52, bottom wall 58 and side walls 54, 56 further define front and rear openings which are substantially rectangular or square in shape. Junction box doors (not shown)

are disposed over the openings in order to close the junction box 50 per applicable electrical codes. The junction box doors (not shown) are connected to the junction box by door apertures 59 located in the bottom wall 58 of the junction box 50 as well as an arm 53 extending across the top wall 52. Otherwise stated, the junction box doors have tabs extending into the apertures 59 to retain a bottom edge of each door. The top edge of each door is retained against the junction box top wall 52 by the arm 53 extending across the junction box top wall 52.

The junction box side walls 54, 56 and the top wall 52 each comprise a plurality of knockouts 55. The knockouts 55 provide a plurality of wire paths for electrical wires and conduit to move from the ballast (not shown) to within the junction box 50 and from within the junction box 50 to the lamp (not shown).

The fixture frame 30 further comprises a frame arm 32 integrally connected to the junction box 50 along an inside edge of the bottom wall 58, having a first end and second end each comprising a mounting bracket 60. The frame arm 32 comprises a first end and a second end where the mounting brackets or frame slides 60 are located for connection of the aperture ring 16. More specifically, the frame arm 32 comprises a first arm portion 34, integrally connected to the junction box 50, and having first and second distal ends. The frame arm 32 further comprises a second arm portion 36 and a third arm portion 38. At a first end of the first arm portion 34 is a first elbow 40 and at a second end of the first arm portion 34 is a second elbow 42. The first and second elbows 40, 42 connect the first arm portion 34 to the second arm portion 36 and third arm portion 38, respectively. Thus, the frame arm 32 is defined by the first arm portion 34, second arm portion 36 and third arm portion 38. However, the frame 30 may be formed of alternative materials, shapes and sizes, as will be understood by one of ordinary skill in the art.

The elbows 40, 42 are formed at ends of the first arm portion 34 to partially define a pre-selected spacing between the second arm portion 36 and the third arm portion 38 as well as between the mounting brackets 60. As best shown in FIG. 1, the spacing between the second and third arm portions 36, 38 (FIG. 2) and the opposed mounting brackets 60 is provided to receive the aperture ring 16 wherein a reflector and lamp may be located. The elbows 40, 42 may be disposed at various positions and in various orientations in order to change the configuration of the frame 30 so that a single blank may be utilized to form a fixture frame 30 which may be used in combination with various light fixture sizes. Thus, although the first, second and third arm portions 34, 36, 38 are described as part of the frame arm 32, the elbows 40, 42 are the structural feature which distinguish these portions from one another.

Still referring to FIG. 2, at distal ends of the second and third arm portions 36, 38 the opposed mounting brackets 60 define components of the adjustment assembly 14 (FIG. 1). The U-shape of mounting bracket 60 is defined by a web 64 which is substantially rectangular in shape and two opposed flanges 66 extending along opposed vertical edges of the web 64. In other words, the web 64 and flanges 66 define a channel or U-shaped mounting bracket 60. However, other shapes may be utilized which provide the function described herein. Along the web 64 of the mounting bracket 60 is a slot 62 which is substantially rectangular in shape but which may be formed in a plurality of shapes. The slot 62 generally extends from an upper portion of the web 64 to a lower portion of the web 64. The slot 62 further comprises a small transverse or horizontal notch 63 adjacent the slot 62. Further, the mounting bracket 60 comprises a plurality of apertures 65 which are arranged so as to be parallel to the slot 62. The apertures 65 are arranged at preselected heights for arranging the height of the aperture ring 16, frame 30, and hanger bars 12 prior to installation as will be described further herein.

Connected to the flat upper surface 18 of the aperture ring 16 are aperture ring brackets 20 at diametrically opposed locations along the surface 18. The aperture ring slides or brackets 20 are each substantially L-shaped having a foot 21, connected to the flat upper surface 18 of aperture ring 16, and a vertically extending channel portion 22. The channel portion 22 is positioned between the flanges 66 of the mounting bracket 60. Thus, the web 64 of the mounting bracket 60 is wider than the channel 22 so that each part can slide relative to the other. A vertically extending slot 24 is disposed through the channel portion 22. The slot 24 is aligned with the slot 62 of the mounting bracket 60 when the aperture ring bracket 20 is positioned adjacent the inner surface of the mounting bracket 60 as shown in FIG. 1. Thus, the aperture ring bracket 20 is slideably positioned against the mounting bracket 60 providing vertical movement for the aperture ring bracket 20, the aperture ring 16 and the frame 30. The aperture ring bracket 20 further comprises a plurality of vertically oriented apertures or holes 25 which may be aligned in preselected positions with the holes or apertures 65 along the mounting bracket to dispose the aperture ring 16 in preselected positions relative to the frame 30 prior to installation of the frame-in kit 10.

Adjacent to the aperture ring 16 and aperture ring brackets 20 are sliding clamps 70 which further define the adjustment assembly 14. The sliding clamps or hanger bar slides 70 are substantially C-shaped having upper horizontal surfaces or flanges 76 and lower horizontal surfaces or flanges 72. Extending between clamp flanges 72, 76 is a vertical surface or web 74 defining the C-shape and further defining a position for retaining the hanger bars 12. The lower horizontal surface 72 of the sliding clamp 70 comprises inner and outer clasp apertures 73,75 which may receive a tab from a clasp 80. Although the clamp 70 is shown as C-shaped, various alternative geometries may be utilized which retain the hanger bars 12 in position as well as allowing sliding motion relative to the aperture bracket 20 and mounting bracket 60. On rear or inside surfaces of the webs 74 are tongues or stops 78. When the sliding clamp 70 is disposed against the mounting bracket 60, the stop 78 passes through the horizontal notch 63 allowing upward and downward translation within the vertical slot 62. At upper and lower limits of the slot 62, the stop 78 engages the upper and lower slot ends to limit motion of the sliding clamp 70.

A clasp 80 comprises a metal strap having four edges and a tab 84 depending from a lower edge engages the sliding clamp 70. The tab 84 extends through one of the clasp apertures 73, 75 depending on whether the hanger bar 12 or a conduit, respectively is extending through the sliding clamp 70. The clasp 80 also comprises a bulged portion opposite the vertical surface 74 of the sliding clamp 70. The bulged portion of clasp 46 also provides for positioning of the hanger bars 50 and conduit between the sliding clamp 70 and clasp 80. At the upper end of the clasp 80 is a threaded fastener or stud 82 which extends through the sliding clamp 70, the mounting bracket 60, and the aperture ring bracket 22. On an inner surface of the aperture ring bracket 20, a wing nut or other fastener 86 engaging piece is tightened to allow a releasable means for translation of the mounting bracket 60, the aperture ring bracket 20, and the sliding clamp 70 independently of each other. Otherwise stated these components define the adjustment assembly 14 and allow the hanger bars 12, the aperture ring 16 and frame 30 to be independently adjusted.

Figure 3:
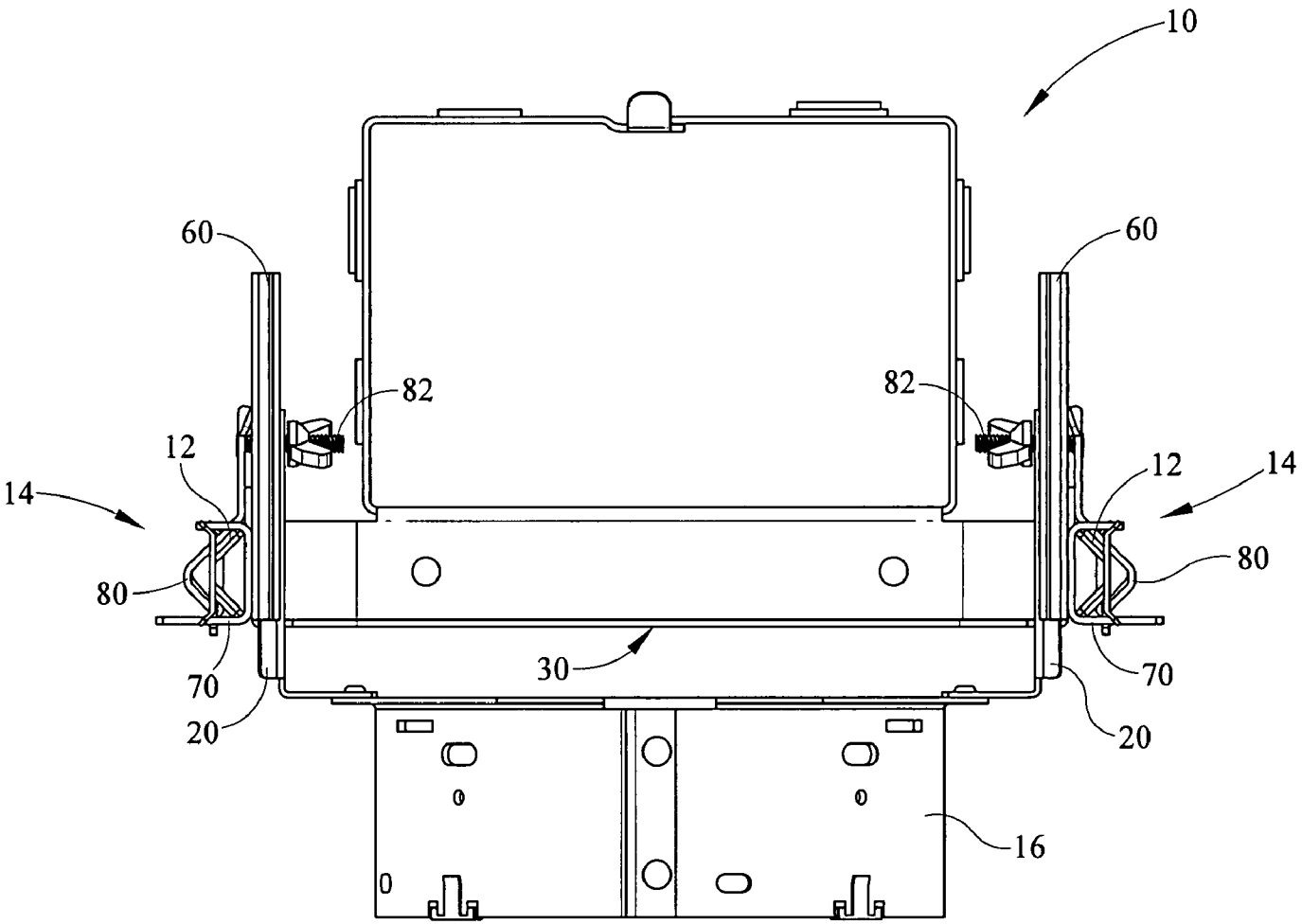
FIG. 3 is a side view of the 3-way adjustment mechanism with fixture frame in an upper position and aperture ring in a lower position.

Referring now to FIG. 3, a side view of the frame-in kit 10 is depicted. As shown in the drawing the stud 82 extends through the sliding clamp 70, the frame mounting bracket 60 and the aperture ring bracket 20. With the wing nut 86 loosened on the stud 82 the aperture ring 16 is disposed downwardly to a lower position so that the upper end of vertical slot 24 engages the stud 82. The frame 30 is also slidable and is depicted in an uppermost position relative to the aperture ring 16 and aperture ring bracket 20 and hanger bars 12. One of ordinary skill in the art should further understand that the hanger bars 12 are also free to move with the sliding clamp 70 upwardly and downwardly however, for purpose of understanding this description, the sliding clamp 70 and hanger bars 12 are generally described as being stationary since during installation they are fixed between joists or suspended ceiling structure. Therefore, for purpose of clarity, the frame mounting bracket 60 and aperture ring bracket 20 are described as moving relative to the hanger bars 12 and sliding clamp 70.

Figure 4:
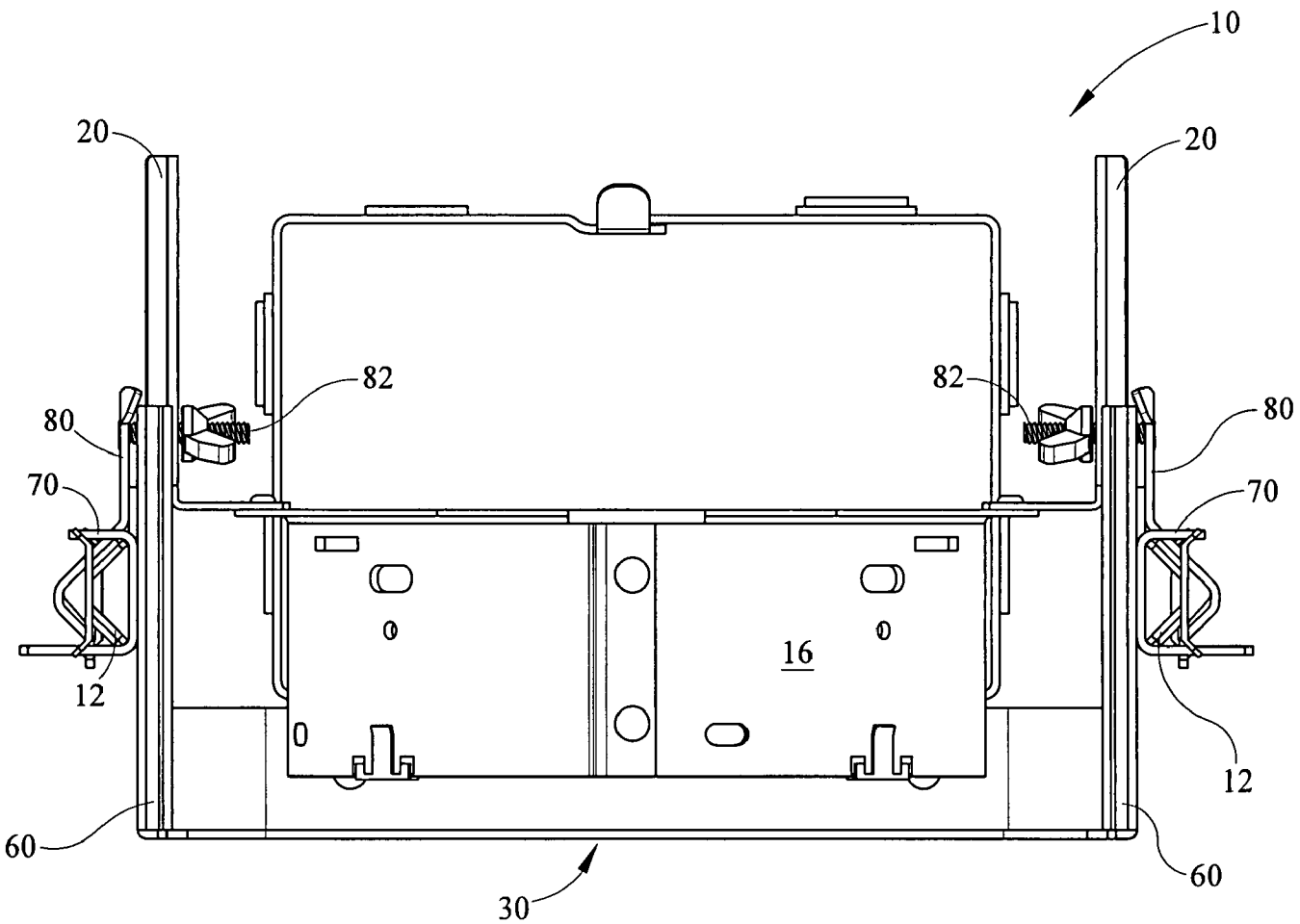
FIG. 4 is a side view of the 3-way adjustment mechanism with fixture frame in a lower position and aperture ring in an upper position opposite FIG. 3.

Referring now to FIG. 4, the frame 30 is depicted in a fully downward position while the aperture ring 16 is depicted in a fully upward position. Accordingly, the aperture ring bracket 20 is disposed wherein the lowermost portion of the slot 24 engages the stud 82. Further the tongue 78 of the sliding clamp 70 also engages the uppermost edge of the slot 62 (FIG. 2) of the frame mounting bracket 60. Thus the frame 30 is at a lower limit and the aperture ring 16 at an upper limit. This is not indicative of typical installations since the frame 30 typically abuts the top surface of the ceiling or suspended ceiling panel and the aperture ring 16 is typically flush with the lower surface of the ceiling panel.

Figure 5:
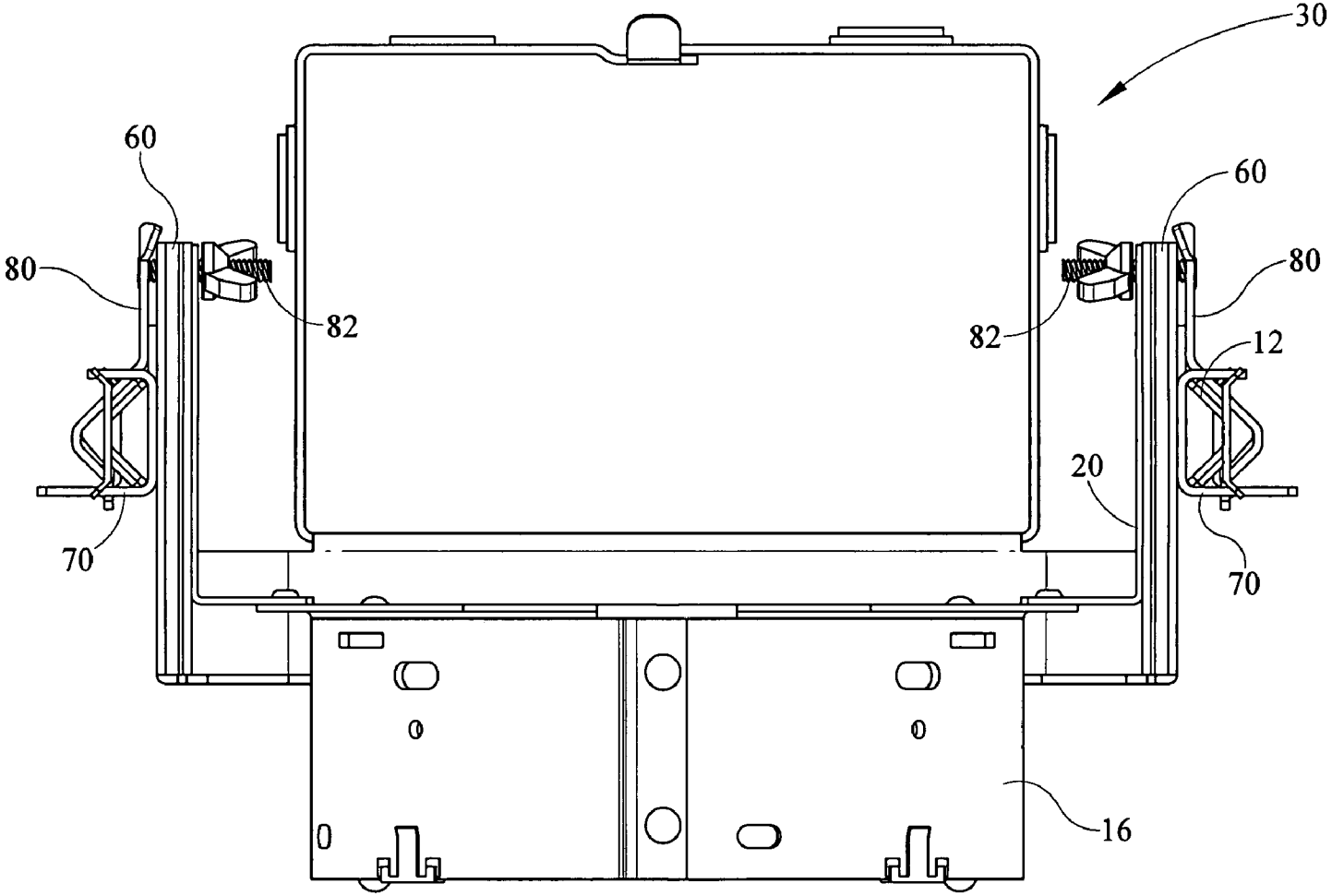
FIG. 5 is a side view of the 3-way adjustment mechanism with fixture frame and aperture ring both disposed in a lower position.

Referring now to FIG. 5, the sliding mechanism 14 is shown disposed such that the ring aperture 16 and frame 30 are in lowermost positions relative to the hanger bars 12 and the sliding clamp 70. It should be understood however that the sliding clamp 70, the aperture ring mounting bracket 20 and the frame mounting bracket 60 all may be moved independently of one another in order to independently move the 20 hanger bars 12, the aperture ring 16 and the frame 30.

Figure 6:
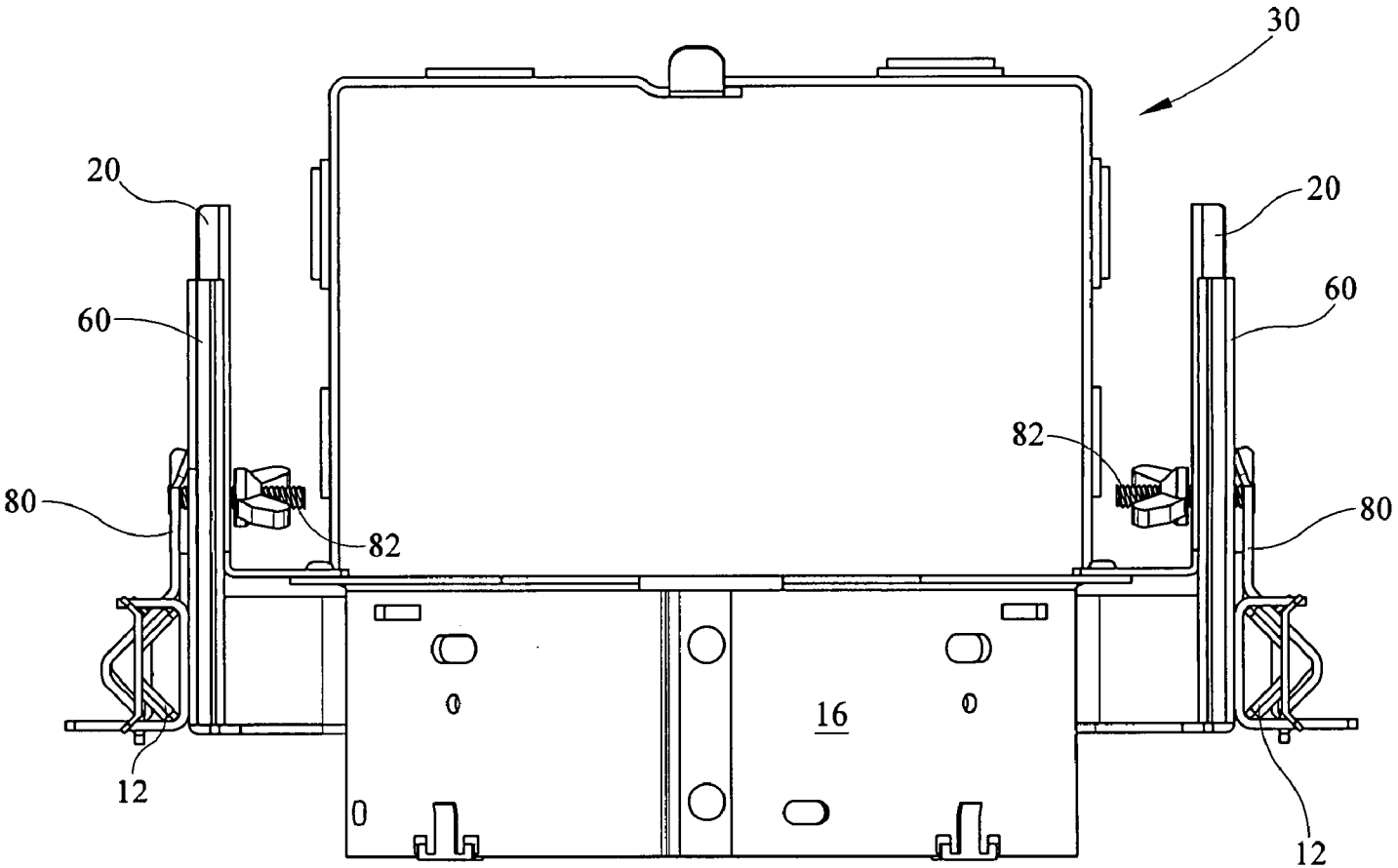
FIG. 6 is a side view of the 3-way adjustment mechanism with fixture frame and aperture ring both disposed in an upper position.

Referring now to FIG. 6, the frame 30 and aperture ring 16 are both moved to an uppermost positions relative to the hanger bars 12. Accordingly, the aperture ring bracket 20 and frame mounting bracket 60 are also moved fully upwardly relative to the stud 82.

Figure 7:
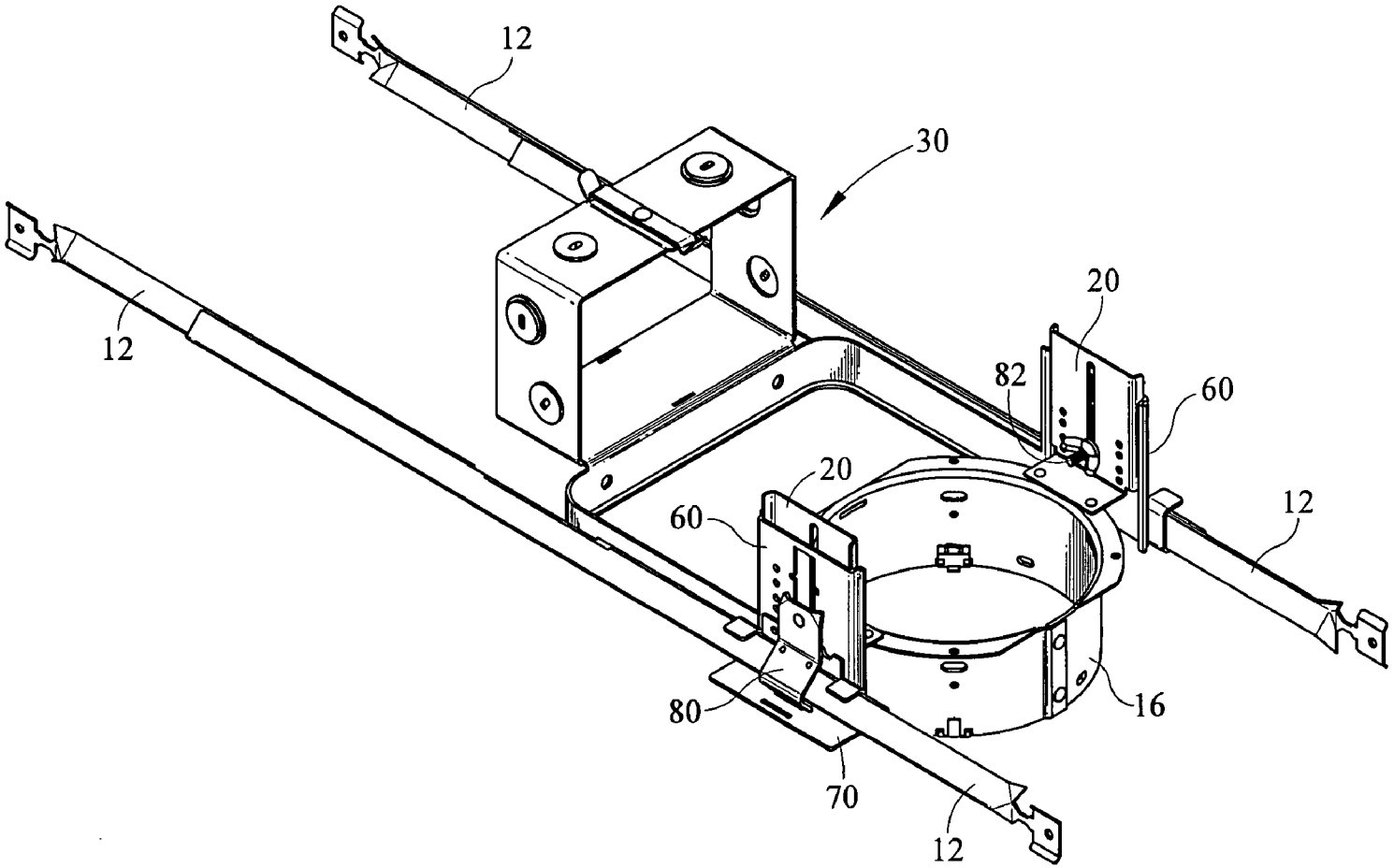
FIG. 7 is a perspective view that shows the fixture frame adjusted laterally on the hanger bars.
Figure 8:
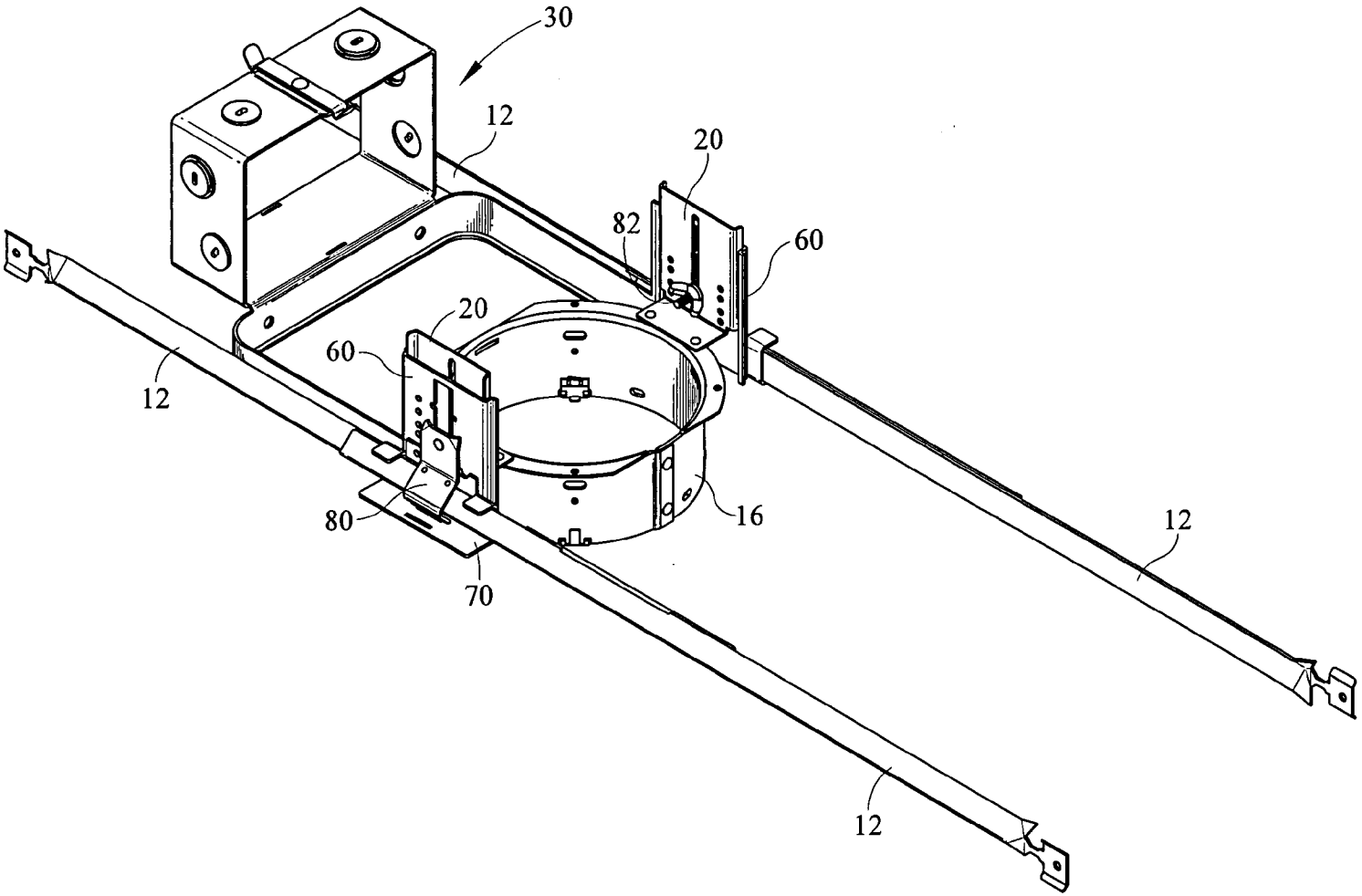
FIG. 8 is a perspective view that shows the fixture frame adjusted laterally, opposite of FIG. 7, on the hanger bars; and, FIG. 9 is a side-sectional view of the 3-way adjustment mechanism and fixture frame-in kit.

Referring now to FIGS. 7 and 8, the frame-in kit 10 provides a further adjustment. Specifically, the frame 30 may be translated in the axial direction of the hanger bars 12 from a first position to a second position and in between, including a centered position. The translation of the frame 30 between axial extremities of the hanger bar 12 is useful when the aperture ring 16 is installed in a non-centered position of a suspended ceiling panel. Thus, as shown in FIGS. 7 and 8 the frame 30 may be positioned at either end of the hanger bars 12 to provide yet a further degree of freedom for the frame 30 and aperture ring 16.

In order to operate the adjustment assembly 14, the frame-in kit 10 must initially be assembled. Accordingly, the frame mounting bracket 60 and aperture ring bracket 20 are slideably positioned adjacent one another as shown in the various figures. Next the stop 78 of the sliding clamp 70 is disposed through the notch 63 and disposed within each slot 62 on the mounting brackets 60. The clasps 80 are positioned within one of the apertures 73, 75 of the sliding clamp 70 so that the stud 82 extends through the sliding clamp 70, mounting bracket 60 and slot 24 of the aperture ring bracket 20. A fastener such as the exemplary wing nut 86 may be attached to the threaded stud 82 and slightly tightened wherein the hanger bars 12 may be positioned through the opening defined between the sliding clamp 70 and clasp 80. When this assembly is complete the wing nut 86 should be sufficiently loosened so that the frame 30, aperture ring 16 and hanger bars 12 are movable independent of each other.

Figure 9:
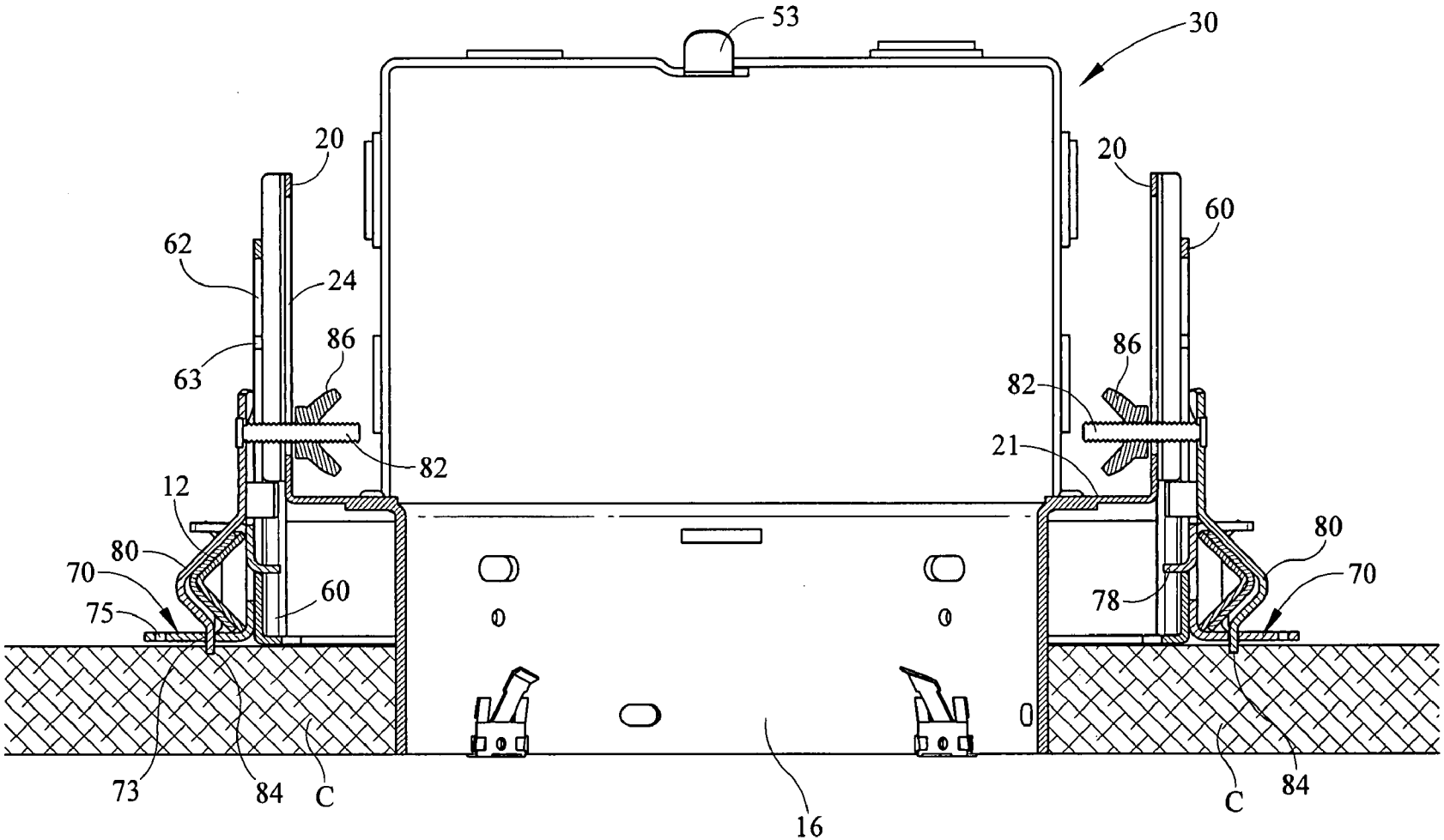

The hanger bars 12 are positioned as necessary in the ceiling structure, for example, the hanger bars 12 may be connected between ceiling joists or T-bars or other such structural members defining a frame for a suspended ceiling. For purpose of clarity, the term ceiling should be understood to include both ceilings and suspended ceiling systems. Next, with an aperture cut in the ceiling beneath the frame-in kit 10, and the stud 82 and wing nut 86 loosened, the aperture ring 16 falls through a suspended ceiling aperture until the upper surface 18 engages the upper surface of the ceiling. Further, the frame 30 will fall down to the upper surface of the ceiling and be seated. This maximizes clearance between mechanical and electrical components within the ceiling cavity and the junction box 50 and frame 30. With the aperture ring 16 extending through an aperture in the ceiling, the installer merely needs to push the aperture ring 16 upwardly so that the aperture ring 16 is flush with the lower surface of the ceiling while the frame 30 is maintained flush with the upper surface of the ceiling. Since the aperture ring 16 moves independent of the frame 30, the movement of the aperture ring 16 does not cause the frame 30 to interfere with other components in the ceiling cavity. Next, the installer tightens the fastener 86 connected to the stud 82 so that the frame 30 and aperture ring 16 are locked in position and further so that the frame 30 is held in place relative to the hanger bars 12. Accordingly, the frame 30 cannot move laterally or vertically while the aperture ring 16 also can not move vertically. FIG. 9 depicts a side sectional view of the adjustment assembly 14 fully tightened and locked so that the frame 30, aperture ring 16 and hanger bars 12 cannot move independently of one another.

Referring again to FIGS. 1 and 2, an alternative method of installation may be utilized. As seen in the Figures and previously described, the bracket 20 comprises a plurality of vertically arranged apertures 25. The apertures 25 are aligned with vertically arranged apertures 65 on the frame mounting bracket 60. When the frame-in kit 10 is assembled as shown in FIG. 1, the apertures 25 and 65 are aligned and provided preselected alignment settings wherein the frame 30 and aperture ring 16 may be locked prior to installation of the frame-in kit 10 in the ceiling cavity. Otherwise stated, by placing an alignment tool, such as a screw, bolt, rivet, rod wire, or the like, through the holes 25,65, or simply by visual alignment, the frame 30 and aperture ring 16 may be aligned in pre-set positions relative to the other. Then the wing-nut 86 is tightened to lock the adjustment assembly 14 in position. This is extremely helpful once the installer has determined the proper settings to compensate for ceiling cavity depth and ceiling panel thickness. Further, as shown in FIG. 1, a tab extends upwardly from the sliding clamp 70 and also receives a fastener (not shown) which may extend through the apertures 25 and 65. Thus, the apertures provide that the hanger bars 12, frame 30 and aperture ring 16 may be locked in position prior to installation in the ceiling cavity if the installer knows which apertures to align. In most cases, the installer will know which positions are needed after installing a first fixture frame-in kit 10.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An adjustable fixture frame mechanism, comprising:

a fixture frame;

an adjustment assembly connected to said fixture frame slidably connecting an aperture ring to said frame;

said aperture ring slidably adjustable through a vertical plane relative to said fixture frame;

said fixture frame and said aperture ring also being slidable relative to a plurality of hanger bars;

said adjustment assembly comprising a frame mounting bracket, an aperture ring bracket slidably connected to said frame mounting bracket, and a hanger bar bracket.

2. The adjustable fixture frame mechanism of claim 1, said aperture ring bracket slidably disposed along an inner surface of said frame mounting bracket.

3. The adjustable fixture frame mechanism of claim 1, said hanger bar bracket slidably connected to said frame mounting bracket.

4. The adjustable fixture frame mechanism of claim 1, said frame mounting bracket disposed between said hanger bar bracket and said aperture ring bracket.

5. The adjustable fixture frame mechanism of claim 1, said hanger bar bracket connecting hanger bars to said fixture frame and said aperture ring.

6. The adjustable fixture frame mechanism of claim 1 further comprising a releasable fastener extending through said adjustment assembly.

7. An adjustable fixture frame mechanism, comprising:

a fixture frame;

an aperture ring slidably connected to said frame by a sliding adjustment assembly;

hanger bars retained by said sliding adjustment assembly and slidable relative to said fixture frame and aperture ring;

said frame being vertically slidable independent of said aperture ring.

8. The adjustable fixture frame mechanism of claim 7, said sliding adjustment assembly allowing independent vertical sliding adjustment of said fixture frame, said aperture ring, and said hanger bars.

9. The adjustable fixture frame mechanism of claim 7, said adjustment assembly comprising an aperture ring bracket, a frame mounting bracket and a sliding clamp.

10. The adjustable fixture frame of claim 9, each of said aperture ring bracket and frame mounting bracket being slidable relative to the other.

11. An adjustable fixture assembly, comprising:

a frame slide, a hanger bar slide and an aperture ring slide;

said frame slide vertically moveable relative to said hanger bar slide and said aperture ring slide;

said aperture ring slide vertically moveable relative to said hanger bar slide and said frame slide.

12. The adjustable fixture assembly of claim 11 further comprising apertures for preselected positions of a frame and an aperture ring.

13. The adjustable fixture assembly of claim 11 further comprising a frame connected to said frame slide.

14. The adjustable fixture assembly of claim 11 further comprising a plurality of hanger bars retained by said hanger bar slide.

15. The adjustable fixture assembly of claim 11 further comprising an aperture ring connected to said aperture ring slide.

16. An adjustable mechanism for a fixture, comprising:

a fixture frame;

a plurality of hanger bars;

an aperture ring;

an adjustment assembly slidably connecting said fixture frame, said plurality of hanger bars, and said aperture ring;

wherein each of said fixture frame and said aperture ring slide relative to the other and said hanger bars.

17. The adjustment mechanism of claim 16, said adjustment assembly comprising an aperture ring slide, a frame slide and a sliding clamp.

18. The adjustment mechanism of claim 16, each of said aperture ring slide and said frame slide slidably engaging the other.

19. The adjustment mechanism of claim 16, said adjustment assembly further comprising means for setting said assembly at preselected positions.

* * * * *